US009506467B2

(12) United States Patent
Alaze et al.

(10) Patent No.: US 9,506,467 B2
(45) Date of Patent: Nov. 29, 2016

(54) INTERNAL GEAR PUMP

(71) Applicant: Robert Bosch GmbH, Stuttgart (DE)

(72) Inventors: Norbert Alaze, Markgroeningen (DE); Edgar Kurz, Heilbronn-Horkheim (DE); Rene Schepp, Waiblingen (DE); Michael Eisenlauer, Affalterbach (DE); Massimiliano Ambrosi, Benningen (DE)

(73) Assignee: Robert Bosch GmbH, Stuttgart (DE)

( * ) Notice: Subject to any disclaimer, the term of this patent is extended or adjusted under 35 U.S.C. 154(b) by 74 days.

(21) Appl. No.: 14/309,928

(22) Filed: Jun. 20, 2014

(65) Prior Publication Data

US 2014/0377114 A1 Dec. 25, 2014

(30) Foreign Application Priority Data

Jun. 20, 2013 (DE) ..... 10 2013 211 647

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/10*** | (2006.01) |
| ***F04C 15/00*** | (2006.01) |
| ***F04C 27/00*** | (2006.01) |
| ***F04C 2/08*** | (2006.01) |

(52) U.S. Cl.

CPC ..... *F04C 2/102* (2013.01); *F04C 2/086* (2013.01); *F04C 2/101* (2013.01); *F04C 15/0023* (2013.01); *F04C 15/0026* (2013.01); *F04C 27/005* (2013.01); *F04C 27/006* (2013.01); *F04C 2230/603* (2013.01); *F04C 2240/50* (2013.01)

(58) Field of Classification Search

CPC ..... F04C 2/084; F04C 2/086; F04C 2/101; F04C 2/102; F04C 15/0026; F04C 15/0023; F04C 15/0034; F04C 2240/50; F04C 2240/56; F04C 27/005; F04C 27/006; F01C 21/02; F01C 21/108; F01C 1/102

USPC ..... 418/132–133, 166, 170–171, 102

See application file for complete search history.

(56) References Cited

FOREIGN PATENT DOCUMENTS

| | | | | |
|---|---|---|---|---|
| DE | 3939649 A1 * | 1/1991 | ..... | F04C 2/101 |
| DE | 196 13 833 | 10/1997 | | |
| WO | WO 2012103925 A1 * | 8/2012 | ..... | F04C 2/101 |

* cited by examiner

*Primary Examiner* — Theresa Trieu

(74) *Attorney, Agent, or Firm* — Maginot, Moore & Beck LLP

(57) ABSTRACT

An internal gear pump for a hydraulic vehicle brake system comprises a pump shaft, a pinion positioned on the pump shaft, an annulus configured to mesh with the pinion, a shaft bearing positioned on one side of the pinion, and an axial disk. The pinion is configured to conjointly rotate with the pump shaft. The pump shaft is rotatable mounted in the shaft bearing. The axial disk is positioned between the shaft bearing on one end side, and the pinion and the annulus on an opposite end side, and bears sealingly against the pinion and the annulus. The shaft bearing is configured to center the axial disk.

7 Claims, 2 Drawing Sheets

INTERNAL GEAR PUMP

This application claims priority under 35 U.S.C. §119 to patent application No. DE 10 2013 211 647.0, filed on Jun. 20, 2013 in Germany, the disclosure of which is incorporated herein by reference in its entirety.

The disclosure relates to an internal gear pump for a hydraulic vehicle brake system, and particularly to an internal gear pump for use in a slip-controlled and/or power-operated vehicle brake system instead of a piston pump usually used therein, which in slip control systems is often, though not necessarily correctly, referred to as a return pump.

BACKGROUND

The patent DE 196 13 833 B4 discloses an internal gear pump having an annulus and a pinion which is arranged eccentrically in the annulus such that it meshes with the annulus. The pinion is arranged for conjoint rotation on a pump shaft which serves to drive the pinion in rotation. When driven in rotation, the pinion drives the annulus, with which said pinion meshes, in conjoint rotation, with the result that the internal gear pump is driven and delivers fluid in a manner known per se. The pinion is an externally toothed gearwheel and the annulus an internally toothed gearwheel, and they are known as pinion and annulus here for unambiguous designation and to distinguish between them.

At the circumference, the pinion and the annulus delimit toward the inside and toward the outside a crescent-shaped pump space between one another, said pump space being covered laterally by rotationally fixed axial disks which bear in a sealing manner against end sides of the pinion and of the annulus. The lateral sealing is not hermetically sealed, the axial disks bear in the manner of plain bearings against the end sides of the pinion and of the annulus, and limited leakage is acceptable. An optimum between low friction and low leakage should be found.

In the circumferential direction, the axial disks extend at least over a pressure region of the pump space. In the axial direction, the axial disks are pressurized on their outer sides that face away from the pinion and the annulus in what are known as pressure fields and as a result are urged into abutment against the end sides of the pinion and of the annulus. The pressure field is a usually shallow depression which extends approximately over the pump space or the pressure region of the pump space. Such axial disks are also known as pressure disks or control disks or as pressure plates or control plates. They are typically in the form of disks or plates, although this is not essential for the disclosure.

The pump shaft of the known internal gear pump is rotatably mounted on both sides of the pinion in shaft bearings. The shaft bearings are located outside the axial disks, i.e. the axial disks are located between the shaft bearings on one side and the pinion and the annulus on the other side of the axial disks.

SUMMARY

The internal gear pump according to the disclosure comprises at least one axial disk on an end side of the pinion and of the annulus of the internal gear pump, said axial disk bearing in a sealing manner against the end sides of the pinion and of the annulus. The axial disk is located between the pinion and the annulus on one side of the axial disk, and a shaft bearing which centers the axial disk. The term "centering" means that the shaft bearing orients the axial disk radially with respect to the pump shaft. Since the pump shaft usually passes eccentrically through the axial disk, the axial disk is not oriented coaxially with the pump shaft but if necessary a through-hole in the axial disk for the pump shaft to pass through is oriented coaxially with the pump shaft. However, a through-hole in the axial disk for the pump shaft to pass through, said through-hole being coaxial with the pump shaft, is not essential for the disclosure, the through-hole can be eccentric with respect to the pump shaft.

The disclosure allows the pump shaft to pass through the axial disk in a contact-free and thus wear-free and frictionless manner, because the axial disk is not centered on the pump shaft but by the shaft bearing.

The internal gear pump according to the disclosure is suitable for installation in an installation space that is open on only one side. The installation space is for example the interior of a cup-shaped pump housing, i.e. a pump housing that is open only on one end side, or a recess, open on one side, in for example a hydraulic block of a slip-controlled hydraulic vehicle brake system. For installation, first of all the shaft bearing is press-fitted into a bearing seat at the closed end of the installation space, for example of the cup-shaped pump housing or at the bottom of the recess, and subsequently the internal gear pump is inserted or installed.

Hydraulic blocks are known in slip-controlled hydraulic vehicle brake systems and serve for the mechanical fastening and hydraulic interconnection of hydraulic components of the slip control system. In addition to the internal gear pump, such components are solenoid valves, hydraulic accumulators, nonreturn valves, pressure sensors, dampers and the like for the slip control system. The hydraulic block is usually a cuboidal part made of metal, in particular made of an aluminum alloy, in which cylindrical recesses, often with a stepped diameter, are provided as receptacles for the hydraulic components of the slip control system and in which holes are provided to hydraulically interconnect the receptacles or the components installed therein. An electric motor for driving the internal gear pump is fitted on the hydraulic block. The hydraulic block equipped with the hydraulic components and with electrical, electromechanical and electronic components forms a hydraulic unit of the slip control system of a hydraulic vehicle brake system. When the internal gear pump according to the disclosure is installed in such a hydraulic block, the hydraulic block can also be understood to be the pump housing of the internal gear pump.

The internal gear pump according to the disclosure can be configured as what is known as a crescent pump with a dividing element arranged in the pump space between the annulus and the pinion, said dividing element dividing a pressure region and a suction region from one another in the pump space. Such dividing elements are also known as filler pieces or, on account of their typical crescent or half-crescent shape, also as crescent pieces. The internal gear pump according to the disclosure can also be configured as an internal gear pump without a dividing element, this pump also being known as an annular gear pump.

The claims relate to advantageous refinements and developments of the disclosure.

A preferred refinement of the disclosure according to the disclosure provides for the shaft bearing which centers the axial disk to protrude axially into the installation space and to engage in a centering manner in a complementary cutout, for example a cylindrical recess in the axial disk. This refinement of the disclosure is provided in particular for a closed end of a cup-shaped pump housing or a bottom of a recess in which the internal gear pump is installed. It allows the axial disk to be centered easily via the shaft bearing with respect to the pump shaft. The cutout in the axial disk, in which the shaft bearing engages, may be for example a recess or a through-hole. As a result of the engagement of the shaft bearing in the axial disk, an axial overall length of the internal gear pump is shortened by an axial depth of the engagement. A clearance fit of the axial disk on the shaft bearing allows axial movability of the axial disk. A clearance fit of the axial disk on the shaft bearing or axial movability of the axial disk is not necessary in each case.

An embodiment provides a configuration of the internal gear pump without the one shaft bearing as a subassembly which is preassemblable and, following preassembly, is handlable as a unitary component and installable in an installation space. The configuration of the internal gear pump as a subassembly simplifies its assembly and installation in the installation space. Preferably, prior to the installation of the internal gear pump, the shaft bearing is press-fitted into a bearing seat in the installation space. Alternatively, it is possible to embody the shaft bearing as a constituent part of the subassembly, in that its inner ring is press-fitted onto the pump shaft such that the axial movability of the axial disk is retained. An outer ring of the shaft bearing is in this case not press-fitted into the bearing seat in the installation space of the internal gear pump but has a sliding seat and passes into the bearing seat when the subassembly is installed in the installation space. The bearing seat in the installation space is axially somewhat deeper and so the shaft bearing has a little play axially in order to be able to compensate tolerances.

An embodiment provides for the use of the internal gear pump according to the disclosure as a hydraulic pump of a hydraulic, slip-controlled and/or power-operated vehicle brake system. In slip-controlled vehicle brake systems, hydraulic pumps are also known as return pumps and are nowadays embodied predominantly as piston pumps.

An embodiment provides for the installation of the internal gear pump according to the disclosure in a hydraulic block of a hydraulic, slip-controlled and/or power-operated vehicle brake system. The hydraulic block can be understood to be the pump housing of the internal gear pump.

BRIEF DESCRIPTION OF THE DRAWINGS

The disclosure is explained in more detail in the following text with reference to an embodiment illustrated in the drawing, in which.

DETAILED DESCRIPTION

Figure 1:
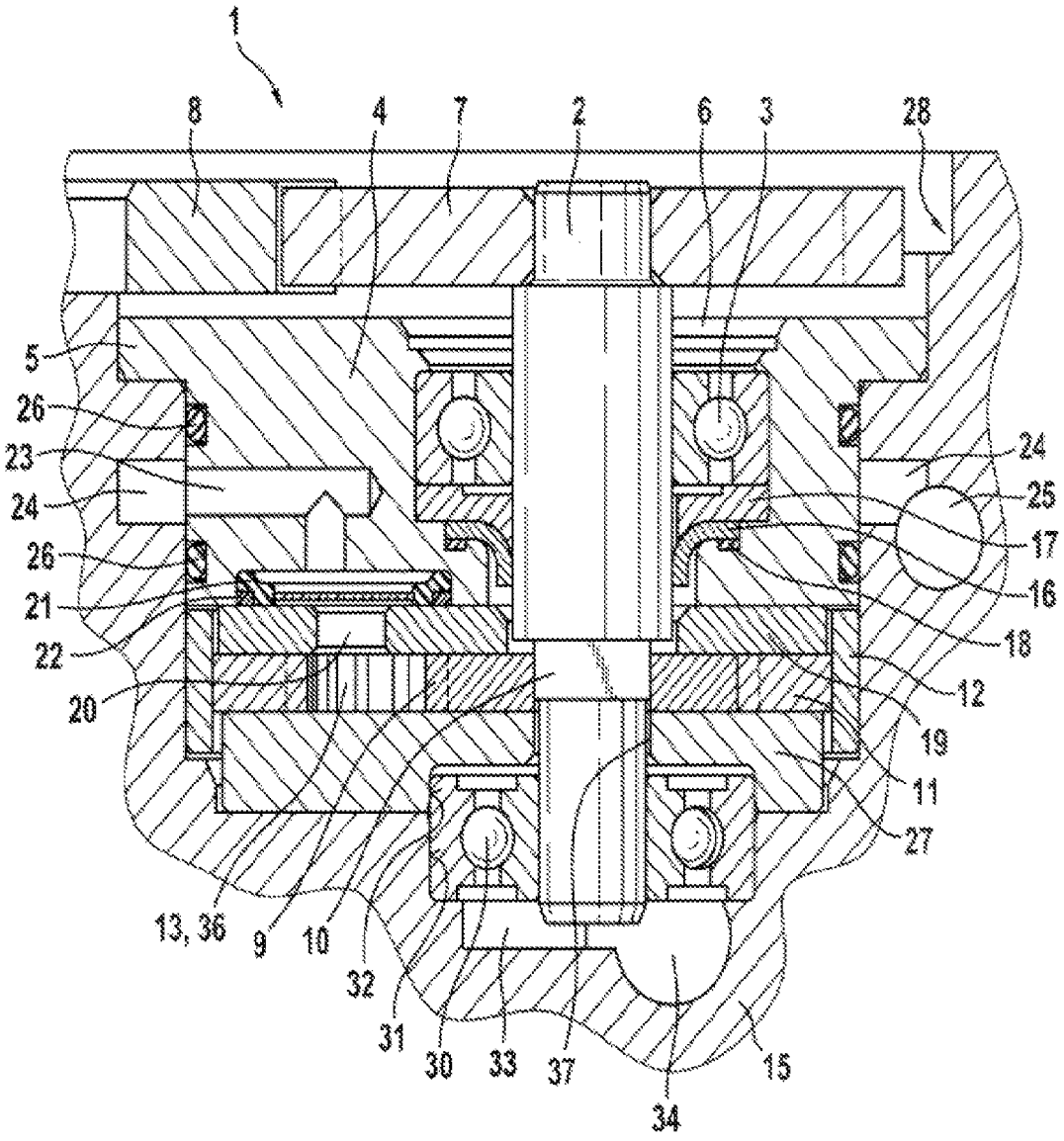
FIG. 1 shows an axial section through an internal gear pump according to the disclosure.

The internal gear pump 1 according to the disclosure, illustrated in FIG. 1, has a pump shaft 2 which is mounted rotatably by way of a bearing, in the embodiment a ball bearing 3, in a cover 4. The cover 4 is a cylindrical part having a flange 5 at one end. It has an axially parallel through-hole 6, having a multiply stepped diameter, for the pump shaft 2, which is off-center in the cover 4, to pass through. A gear wheel, known as a drive gear 7 here, is press-fitted onto one end, projecting from the cover 4, of the pump shaft 2, or is arranged thereon for conjoint rotation in some other way. The drive gear 7 meshes with a gear wheel, known here as the driving gear 8, which is drivable in rotation by way of an electric motor (not illustrated), if necessary with a transmission connected in between.

On another side of the ball bearing 3 from the drive gear 7, an externally toothed gear wheel, known here as the pinion 9, is arranged on the pump shaft 2. The pinion 9 is axially movable and arranged on the pump shaft 2 for conjoint rotation; in the embodiment, the axial movability and conjoint rotation are achieved by a square 10, although the disclosure is not limited to this option. The pinion 9 is located in an internally toothed gear wheel, known here as the annulus 11, which is arranged at the same level as the pinion 9 and has the same width as the pinion 9. The annulus 11 is coaxial with the cylindrical cover 4 and off-center with respect to the pump shaft 2 and to the pinion 9, such that the pinion 9 and the annulus 11 mesh with one another. When the pinion 9 is driven in rotation with the pump shaft 2, the pinion 9 drives the annulus 11 meshing therewith in conjoint rotation. The annulus 11 is press-fitted into a bearing ring 12.

Figure 2:
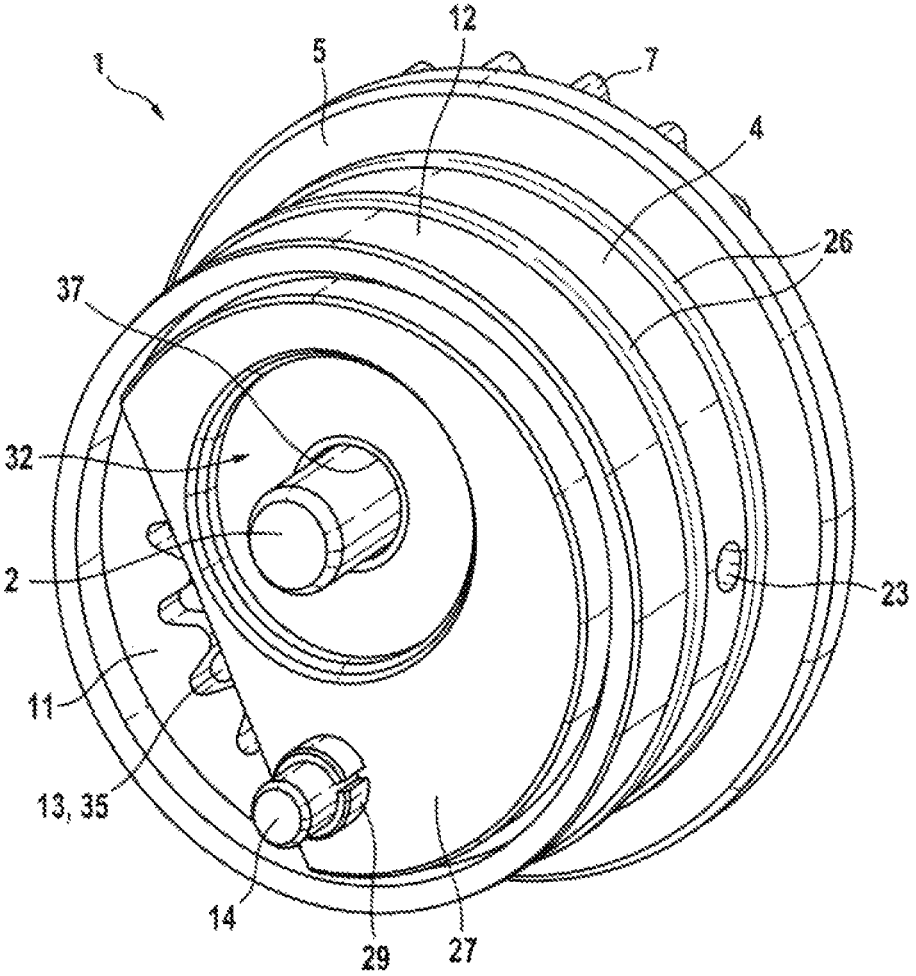
FIG. 2 shows a perspective illustration of the internal gear pump from FIG. 1.

The pinion 9 and the annulus 11 enclose a crescent-shaped pump space 13 between one another in a circumferential section in which they do not mesh with one another. Arranged in the pump space 13 is a half-crescent-shaped dividing element (not visible in the drawing) which divides the pump space 13 into a suction space 35 and a pressure space 36. The dividing element is the same width as the pinion 9 and the annulus 11. Tooth tips of teeth of the annulus 11 bear against a cylindrical outer surface of the dividing element, which is also known as a filler piece or, on account of its shape, as a crescent, and tooth tips of teeth of the pinion 9 bear against a cylindrical inner surface of the dividing element. The dividing element is supported in the circumferential direction against a pin 14 (FIG. 2) which passes through the pump space 13 in an axially parallel manner at an end of the dividing element on the suction space side. One end of the pin 14 is in a blind hole in the cover 4, the other end, which protrudes in FIG. 2, is held in a blind hole in a hydraulic block 15. The pin 14 is located outside the section plane in FIG. 1 and is thus not visible therein. As a result of the pinion 9 and the annulus 11 being driven in rotation, the internal gear pump 1 delivers fluid, in the embodiment brake fluid, from the suction space 35 in tooth gaps of the pinion 9 and of the annulus 11 internally and externally along the dividing element into the pressure space 36.

Arranged between the ball bearing 3 and the pinion 9 is a sealing arrangement having a sealing sleeve 16, a support ring 17 and a secondary seal 18 which seals off the pump shaft 2 in the cover 4. The sealing sleeve 16 is in the form of a trumpet bell and arranged such that it is urged against the pump shaft 2 in the event of any pressurization. The support ring 17, which is located between the ball bearing 3 and the sealing sleeve 16, has a concavely curved annular end face, corresponding to a curvature of the sealing sleeve 16, the sealing sleeve 16 resting against said annular end face. The secondary seal 18 is a sealing ring which is arranged in an end groove in an annular step of the through-hole 6 in the cover 4. The secondary seal 18 is located on an external circumference of the sealing sleeve 16 on a side opposite the support ring 17 and clamps an external periphery of the sealing sleeve 16 between itself and the support ring 17.

Located between the sealing arrangement 16, 17, 18 and the pinion 9 and the annulus 11 there is a pressure disk 19 which bears against end sides of the pinion 9, of the annulus 11 and of the dividing element (not visible in the drawing). The pressure disk 19 has a through-hole for the pump shaft 2, a through-hole for the pin 14 (not visible in FIG. 1) which passes in an axially parallel manner through the suction space 35 in the pump space 13 between the annulus 11 and the pinion 9 and holds the dividing element in the circumferential direction, and a through-hole 20 through which the pressure space 36 of the pump space 13 communicates with a pressure field 21 and which is part of a pump outlet. The pin 14 also holds the pressure disk 19 in a rotationally fixed manner. In plan view, the pressure disk 19 has the form of a circle segment which takes up more than a semicircle, wherein a step has been removed from the circle segment at one corner. The pressure disk 19 covers the non-visible dividing element and the pressure space 36 of the pump space 13 on one side.

On an inner side facing the pressure disk 19, i.e. on an outer side, facing away from the pinion 9 and the annulus 11, of the pressure disk 19, the cover 4 has the pressure field 21. The pressure field 21 is a shallow depression having an approximately half-crescent shape which extends approximately over the pressure space 36 and over a part of the dividing element. The pressure field 21 is enclosed by a pressure field seal 22 which seals off the pressure field 21 between the cover 4 and the pressure disk 19. Rather than in the cover 4, as illustrated, the pressure field 21 can also be provided in the outer side of the pressure disk 19 (not illustrated). The pressure disk 19 has the through-hole 20 which leads from the pressure space 36 of the pump space 13 into the pressure field 21. Via the through-hole 22, the pressure field 21 communicates with the pressure space 36 of the internal gear pump 1, such that the same pressure prevails in the pressure field 21 as in a pump outlet. On account of the pressurization in the pressure field 21, the pressure disk 19 is urged into sealing abutment against the end sides of the piston 9, of the annulus 11 and of the dividing element. The pressure disk 19 bears in the manner of a hydrodynamic plain bearing against the end sides of the piston 9, of the annulus 11 and of the dividing element; it does not seal off hermetically. An optimum or at least favorable ratio should be selected between friction between the rotating pinion 9 and the rotating annulus 11, on the one hand, and the rotationally fixed pressure disk 19, on the other hand, and low leakage, which is selectable substantially by the size, shape and position of the pressure field 21.

From the pressure field 21, an angled hole 23 in the cover 4 runs a short distance axially parallel and subsequently radially outward to a circumference of the cover 4. The through-hole 22 in the pressure disk 19 and the angled hole 23 in the cover 4 are constituent parts of a pump outlet of the internal gear pump 1. The angled hole 23 in the cover 4 leads into an annular groove 24 in the abovementioned hydraulic block 15, which encloses the cover 4 at the level of the radial part of the angled hole 23. The annular groove 24 is intersected by an outlet hole 25 which is likewise provided in the hydraulic block 15 and is, like the annular groove 23, part of the pump outlet.

On both sides of the mouth of the angled hole 23 at the circumference of the cover 4, and thus on both sides of the annular groove 24 in the hydraulic block 15, the cover 4 has two sealing rings 26 which are arranged in circumferential grooves in the cover 4 and seal off on both sides the annular groove 24 between the hydraulic block 15 and the cover 4.

On an opposite side of the pinion 9 and the annulus 11 from the pressure disk 19, the internal gear pump 1 has an axial disk 27 which bears in a sealing manner against the end sides of the pinion 9, of the annulus 11 and of the dividing element. The axial disk 27 is in the form of a circle segment and, like the pressure disk 19, takes up more than a semicircle. It is, like the pressure disk 19, passed through by the pin 14 (not visible in FIG. 1) on which the dividing element (likewise not visible) is supported in the circumferential direction. The pin 14 holds the axial disk 27 in a rotationally fixed manner. The axial disk 27 has an off-center, cylindrical through-hole 37 which is coaxial with the pump shaft 2 and through which the pump shaft 2 passes. The through-hole 37 in the axial disk 27 is larger than a diameter of the pump shaft 2, such that there is an annular gap between the pump shaft 2 and the through-hole 37 in the axial disk 27.

Use is made as captive retention means of a clamping sleeve 29 which is arranged on the pin 14 and in a through-hole in the axial disk 27, the pin 14 passing through the axial disk 27 via said through-hole. The clamping sleeve 29 holds the axial disk 27 on the pin 14 and thus on or in the internal gear pump 1. It is required only until the internal gear pump 1 is installed in the installation space 28 of the hydraulic block 15; afterwards it is dispensable per se. The clamping sleeve 29 allows an axial movement of the axial disk 27.

As a result of the pressurization of the outer side of the pressure disk 19 in the pressure field 21, the axially movable pressure disk 19 is urged against the end sides of the pinion 9, of the annulus 11 and of the dividing element, and the end sides, facing away from the pressure disk 19, of the axially movable pinion 9, of the axially movable annulus 11 and of the axially movable dividing element are urged against the facing inner side of the axial disk 27, such that the end sides of the pinion 9, of the annulus 11 and of the dividing element 13 also bear in a sealing manner against the axial disk 27. Here too, the abutment is in the manner of a hydrodynamic plain bearing, and sealing is not hermetic but exhibits leakage.

The internal gear pump 1 is a subassembly which is preassemblable and the function of which is testable before it is installed in the hydraulic block 15. The hydraulic block 15 has a stepped blind hole as installation space 28 for the internal gear pump 1, the gear pump 1 being inserted into said blind hole and being secured for example by staking. The hydraulic block 15 is part of a slip control system (not illustrated) of a hydraulic vehicle brake system. The hydraulic block 15 is a cuboidal part made of aluminum alloy which has a second recess as receptacle 28 for a second internal gear pump 1 and further recesses for hydraulic components of the slip control system. Such components are not illustrated solenoid valves, hydraulic accumulators, pressure sensors etc. The abovementioned electric motor (not illustrated) is flanged onto the outside of the hydraulic block 15, the driving gear 8 being fitted onto the motor shaft of said electric motor or onto a drive transmission shaft of a transmission flanged onto the electric motor, said driving gear 8 driving the two internal gear pumps 1 via the drive gears 7. The receptacles for the hydraulic components are connected together via holes in the hydraulic block 15, with the result that the hydraulic components (not illustrated) of the slip control system are connected hydraulically together. Equipped with the hydraulic components and provided with the electric motor and further electrical, electromechanical and electronic components, the hydraulic block 15 forms a hydraulic unit and a slip control unit of the hydraulic vehicle brake system.

The bearing ring 12, into which the annulus 11 of the internal gear pump 1 is press-fitted, is mounted in a sliding manner in the stepped blind hole in the hydraulic block 15, said blind hole forming the installation space 28 for the internal gear pump 1.

Arranged on an outer side, facing away from the pinion 9 and the annulus 11, of the axial disk 27 is a ball bearing, i.e. a roller bearing as shaft bearing 30, which mounts the pump shaft 2 in a rotatable manner. A roller bearing as shaft bearing 30 is not essential for the disclosure. The shaft bearing 30 is press-fitted into a bearing seat 31 at a bottom of the blind hole in the hydraulic block 15, said blind hole forming the installation space 28 for the internal gear pump 1. The bearing seat 31 is a cylindrical extension at the bottom of the installation space 28, said extension being coaxial with the pump shaft 2 and thus off-center with respect to the installation space 28.

The bearing seat 31 is less deep than the shaft bearing 30 is wide, and so the shaft bearing 30 protrudes axially a short distance out of the bearing seat 31 into the installation space 28. The axial disk 27 has a cylindrical recess 32 in which the (one outer ring of the) shaft bearing 30 engages. As a result of the engagement of the shaft bearing 30 in the recess 32 in the axial disk 27, the shaft bearing 30 centers the axial disk 27, i.e. the shaft bearing 30 orients the axial disk 27 radially with respect to the pump shaft 2. Between the shaft bearing 30 and the recess 32 in the axial disk 27 there is a clearance fit, such that the axial disk 27 is movable in the axial direction. The through-hole 37 in the axial disk 27, via which through-hole 37 the pump shaft 2 passes through the axial disk 27, has a larger diameter than the pump shaft 2 at this point, and so the pump shaft 2 passes through the axial disk 27 in a contact-free manner. The axial disk 27 is held in a rotationally fixed manner by way of the pin 14 that passes through it.

The axial disk 27 is located between the shaft bearing 30 on its outer side and the pinion 9 and annulus 11 on its inner side. By way of the two bearings 3, 30, the pump shaft 2 is mounted in a rotatable manner on both sides of the pinion 9.

At its bottom, the bearing seat 31 has a shallow, cylindrical extension which forms a fluid space 33. The fluid space 33 is cut out of an inlet hole 34 which is provided in the hydraulic block 15. By way of the inlet hole 34 and the fluid space 33, the shaft bearing 30 is subjected to liquid which the internal gear pump 1 delivers. When the internal gear pump 1 is used as a hydraulic pump of a hydraulic vehicle brake system, the liquid is brake fluid. The shaft bearing 30 is in this way lubricated and cooled and, in its embodiment as a roller bearing or ball bearing, is not sealed off. In principle, the suction space 35 of the pump space 13 can communicate via the shaft bearing 30 with the inlet hole 34, in any case when the shaft bearing is a roller bearing and not a plain bearing. In the illustrated embodiment of the disclosure, a bypass hole (not visible in the drawing), which is provided in the hydraulic block 15, leads to the missing circular cap which the axial disk 27 has on account of its circle segment shape. The pump inlet leads laterally past the axial disk 27 into the exposed pressure space 36 of the pump space 13 (cf. FIG. 2). In principle, it would also be possible for the shaft bearing 30 to be subjected to brake fluid from the pump inlet, even though this is not provided in the embodiment.

As a result of the axial disk 27 being secured on the pin 14 by way of the clamping sleeve 29, the internal gear pump 1, with the exception of the shaft bearing 30, is configured as a subassembly which is preassemblable or preassembled and, following preassembly, i.e. once it has been assembled, is handlable as a unitary component and is installable or insertable into the installation space 28 of the hydraulic block 15. Prior to the installation of the internal gear pump 1 in the installation space 28 of the hydraulic block 15, the shaft bearing 30 is press-fitted into the bearing seat 31. The shaft bearing 30 is provided as what is known as a floating bearing, i.e. the pump shaft 2 has a clearance fit in the shaft bearing 30. In the case of a press fit, the pump shaft 2 could be press-fitted into the shaft bearing 30. In the embodiment, the ball bearing 3 forms a fixed bearing, into the inner ring of which the pump shaft 2 is press-fitted and as a result is axially held.

What is claimed is:

1. An internal gear pump for a hydraulic vehicle brake system, comprising:

a pump shaft;

a pinion positioned on the pump shaft and configured to conjointly rotate with the pump shaft;

an annulus configured to mesh with the pinion;

a shaft bearing positioned on one side of the pinion, the pump shaft being rotatably mounted in the shaft bearing; and an axial disk positioned between the shaft bearing on one end side, and the pinion and the annulus on an opposite end side, the axial disk sealingly bearing against end sides of the pinion and the annulus, wherein the shaft bearing is configured to center the axial disk, and wherein the axial disk is axially movable.

2. The internal gear pump according to claim 1, wherein the shaft bearing engages a complimentary cutout of the axial disk to center the axial disk with respect to the pump shaft.

3. The internal gear pump according to claim 1, wherein the internal gear pump is configured to deliver liquid to the shaft bearing.

4. The internal gear pump according to claim 1, wherein the shaft bearing is a roller bearing.

5. The internal gear pump according to claim 1, wherein the internal gear pump is an internal gear pump subassembly.

6. The internal gear pump according to claim 1, wherein the internal gear pump is a hydraulic pump.

7. The internal gear pump according to claim 6, further comprising a pump housing formed by a hydraulic block.

* * * * *